US010748496B2

(12) United States Patent
Huang

(10) Patent No.: US 10,748,496 B2
(45) Date of Patent: Aug. 18, 2020

(54) DRIVING METHOD AND DRIVING DEVICE FOR DISPLAY PANEL, AND DISPLAY DEVICE

(71) Applicant: HKC Corporation Limited, Shenzhen (CN)

(72) Inventor: Bei Zhou Huang, Shenzhen (CN)

(73) Assignee: HKC CORPORATION LIMITED, Shenzhen (CN)

( * ) Notice: Subject to any disclaimer, the term of this patent is extended or adjusted under 35 U.S.C. 154(b) by 0 days.

(21) Appl. No.: 16/158,730

(22) Filed: Oct. 12, 2018

(65) Prior Publication Data

US 2019/0189071 A1 Jun. 20, 2019

Related U.S. Application Data

(63) Continuation of application No. PCT/CN2018/072027, filed on Jan. 10, 2018.

(30) Foreign Application Priority Data

Dec. 18, 2017 (CN) ..... 2017 1 1368984

(51) Int. Cl.
*G09G 3/36* (2006.01)

(52) U.S. Cl.
CPC ..... *G09G 3/3614* (2013.01); *G09G 3/3607* (2013.01); *G09G 3/3688* (2013.01); *G09G 2300/0452* (2013.01)

(58) Field of Classification Search
CPC ..... G09G 2310/0235; G09G 3/3614; G09G 3/3607; G09G 3/2003; G09G 2300/0452; G09G 2300/0426; G02F 2201/52
See application file for complete search history.

(56) References Cited

U.S. PATENT DOCUMENTS

2013/0321483 A1* 12/2013 You ..... G09G 5/10 345/690
2018/0114478 A1* 4/2018 Tien ..... G09G 3/3614

* cited by examiner

*Primary Examiner* — Yuzhen Shen
(74) *Attorney, Agent, or Firm* — WPAT, PC

(57) ABSTRACT

The disclosure relates to a driving method and a driving device for a display panel, and a display device, wherein the driving method includes dividing a plurality of pixel units of the display panel into a plurality of pixel groups, wherein each pixel group includes three columns of continuously arranged pixel units; applying a drive voltage opposite to a polarity of a first position pixel unit to a second position pixel unit and a third position pixel unit in a same pixel group respectively; applying drive voltages of opposite polarities to every adjacent two columns of the sub-pixels in a same column of the pixel units respectively, and applying drive voltages of different voltage levels to the sub-pixels in the first pixel units and the sub-pixels in the second pixel units respectively; wherein the first pixel units and the second pixel units are adjacently disposed in the display panel.

7 Claims, 8 Drawing Sheets

20

| n | | | n+1 | | |
|---|---|---|---|---|---|
| P1(i, j)<br>H | P2(i, j+1)<br>L | P1(i, j+2)<br>H | P2(i, j+3)<br>L | P1(i, j+4)<br>H | P2(i, j+5)<br>L |
| P2(i+1, j)<br>L | P1(i+1, j+1)<br>H | P2(i+1, j+2)<br>L | P1(i+1, j+3)<br>H | P2(i+1, j+4)<br>L | P1(i+1, j+5)<br>H |
| P1(i+2, j)<br>H | P2(i+2, j+1)<br>L | P1(i+2, j+2)<br>H | P2(i+2, j+3)<br>L | P1(i+4, j+4)<br>H | P2(i+4, j+5)<br>L |
| P2(i+3, j)<br>L | P1(i+3, j+1)<br>H | P2(i+3, j+2)<br>L | P1(i+2, j+3)<br>H | P2(i+5, j+4)<br>L | P1(i+4, j+5)<br>H |

n

| $P_j$ | | | $P_{j+1}$ | | | $P_{j+2}$ | | |
|---|---|---|---|---|---|---|---|---|
| R1<br>H+<br>(i, j) | G1<br>H−<br>(i, j) | B1<br>H+<br>(i, j) | R2<br>L−<br>(i, j+1) | G2<br>L+<br>(i, j+1) | B2<br>L−<br>(i, j+1) | R1<br>H−<br>(i, j+2) | G1<br>H+<br>(i, j+2) | B1<br>H−<br>(i, j+2) |
| R2<br>L+<br>(i+1, j) | G2<br>L−<br>(i+1, j) | B2<br>L+<br>(i+1, j) | R1<br>H−<br>(i+1, j+1) | G1<br>H+<br>(i+1, j+1) | B1<br>H−<br>(i+1, j+1) | R2<br>L−<br>(i+1, j+2) | G2<br>L+<br>(i+1, j+2) | B2<br>L−<br>(i+1, j+2) |
| R1<br>H+<br>(i+2, j) | G1<br>H−<br>(i+2, j) | B1<br>H+<br>(i+2, j) | R2<br>L−<br>(i+2, j+1) | G2<br>L+<br>(i+2, j+1) | B2<br>L−<br>(i+2, j+1) | R1<br>H−<br>(i+2, j+2) | G1<br>H+<br>(i+2, j+2) | B1<br>H−<br>(i+2, j+2) |
| R2<br>L+<br>(i+3, j) | G2<br>L−<br>(i+3, j) | B2<br>L+<br>(i+3, j) | R1<br>H−<br>(i+3, j+1) | G1<br>H+<br>(i+3, j+1) | B1<br>H−<br>(i+3, j+1) | R2<br>L−<br>(i+3, j+2) | G2<br>L+<br>(i+3, j+2) | B2<br>L−<br>(i+3, j+2) |

FIG. 3 n

| $P_j$ | | | $P_{j+1}$ | | | $P_{j+2}$ | | |
|---|---|---|---|---|---|---|---|---|
| R1<br>H−<br>(i, j) | G1<br>H+<br>(i, j) | B1<br>H−<br>(i, j) | R2<br>L+<br>(i, j+1) | G2<br>L−<br>(i, j+1) | B2<br>L+<br>(i, j+1) | R1<br>H+<br>(i, j+2) | G1<br>H−<br>(i, j+2) | B1<br>H+<br>(i, j+2) |
| R2<br>L−<br>(i+1, j) | G2<br>L+<br>(i+1, j) | B2<br>L−<br>(i+1, j) | R1<br>H+<br>(i+1, j+1) | G1<br>H−<br>(i+1, j+1) | B1<br>H+<br>(i+1, j+1) | R2<br>L+<br>(i+1, j+2) | G2<br>L−<br>(i+1, j+2) | B2<br>L+<br>(i+1, j+2) |
| R1<br>H−<br>(i+2, j) | G1<br>H+<br>(i+2, j) | B1<br>H−<br>(i+2, j) | R2<br>L+<br>(i+2, j+1) | G2<br>L−<br>(i+2, j+1) | B2<br>L+<br>(i+2, j+1) | R1<br>H+<br>(i+2, j+2) | G1<br>H−<br>(i+2, j+2) | B1<br>H+<br>(i+2, j+2) |
| R2<br>L−<br>(i+3, j) | G2<br>L+<br>(i+3, j) | B2<br>L−<br>(i+3, j) | R1<br>H+<br>(i+3, j+1) | G1<br>H−<br>(i+3, j+1) | B1<br>H+<br>(i+3, j+1) | R2<br>L+<br>(i+3, j+2) | G2<br>L−<br>(i+3, j+2) | B2<br>L+<br>(i+3, j+2) |

FIG. 4

| | | | | | | | | | | | |
|---|---|---|---|---|---|---|---|---|---|---|---|
| R1 H+ | G1 H− | B1 H+ | R2 L− | G2 L+ | B2 L− | R1 H− | G1 H+ | B1 H− | R2 L+ | G2 L− | B2 L+ |
| R2 L+ | G2 L− | B2 L+ | R1 H− | G2 H+ | B1 H− | R2 L− | G2 L+ | B2 L− | R1 H+ | G1 H− | B1 H+ |
| R1 H+ | G1 H− | B1 H+ | R2 L− | G2 L | B2 L− | R1 H− | G1 H+ | B1 H− | R2 L+ | G2 L− | B2 L+ |
| R2 L+ | G2 L− | B2 L+ | R1 H− | G1 H+ | B1 H− | R2 L− | G2 L+ | B2 L− | R1 H+ | G1 H− | B1 H+ |

FIG. 5a

| | | | | | | | | | | | |
|---|---|---|---|---|---|---|---|---|---|---|---|
| R1 H− | G1 H+ | B1 H− | R2 L+ | G2 L− | B2 L+ | R1 H+ | G1 H− | B1 H+ | R2 L− | G2 L+ | B2 L− |
| R2 L− | G2 L+ | B2 L− | R1 H+ | G2 H− | B1 H+ | R2 L+ | G2 L− | B2 L+ | R1 H− | G1 H+ | B1 H− |
| R1 H− | G1 H+ | B1 H− | R2 L+ | G2 L | B2 L+ | R1 H+ | G1 H− | B1 H+ | R2 L− | G2 L+ | B2 L− |
| R2 L− | G2 L+ | B2 L− | R1 H+ | G1 H− | B1 H+ | R2 L+ | G2 L− | B2 L+ | R1 H− | G1 H+ | B1 H− |

FIG. 5b

| | | | | | | | | | | | |
|---|---|---|---|---|---|---|---|---|---|---|---|
| R1 H+ | G1 H− | B1 H+ | R2 L− | G2 L+ | B2 L− | R1 H− | G1 H+ | B1 H− | R2 L+ | G2 L− | B2 L+ |
| R2 L+ | G2 L− | B2 L+ | R1 H− | G2 H+ | B1 H− | R2 L− | G2 L+ | B2 L− | R1 H+ | G1 H− | B1 H+ |
| R1 H+ | G1 H− | B1 H+ | R2 L− | G2 L | B2 L− | R1 H− | G1 H+ | B1 H− | R2 L+ | G2 L− | B2 L+ |
| R2 L+ | G2 L− | B2 L+ | R1 H− | G1 H+ | B1 H− | R2 L− | G2 L+ | B2 L− | R1 H+ | G1 H− | B1 H+ |
| R1 H+ | G1 H− | B1 H+ | R2 L− | G2 L+ | B2 L− | R1 H− | G1 H+ | B1 H− | R2 L+ | G2 L− | B2 L+ |
| R2 L+ | G2 L− | B2 L+ | R1 H− | G2 H+ | B1 H− | R2 L− | G2 L+ | B2 L− | R1 H+ | G1 H− | B1 H+ |
| R1 H+ | G1 H− | B1 H+ | R2 L− | G2 L | B2 L− | R1 H− | G1 H+ | B1 H− | R2 L+ | G2 L− | B2 L+ |
| R2 L+ | G2 L− | B2 L+ | R1 H− | G1 H+ | B1 H− | R2 L− | G2 L+ | B2 L− | R1 H+ | G1 H− | B1 H+ |
| R1 H+ | G1 H− | B1 H+ | R2 L− | G2 L | B2 L− | R1 H− | G1 H+ | B1 H− | R2 L+ | G2 L− | B2 L+ |
| R2 L+ | G2 L− | B2 L+ | R1 H− | G1 H+ | B1 H− | R2 L− | G2 L+ | B2 L− | R1 H+ | G1 H− | B1 H+ |

FIG. 5c

| | | | | | | | | | | | |
|---|---|---|---|---|---|---|---|---|---|---|---|
| R1 H+ | G1 H− | B1 H+ | R2 L− | G2 L+ | B2 L− | R1 H− | G1 H+ | B1 H− | R2 L+ | G2 L− | B2 L+ |
| R2 L+ | G2 L− | B2 L+ | R1 H− | G2 H+ | B1 H− | R2 L− | G2 L+ | B2 L− | R1 H+ | G1 H− | B1 H+ |
| R1 H+ | G1 H− | B1 H+ | R2 L− | G2 L | B2 L− | R1 H− | G1 H+ | B1 H− | R2 L+ | G2 L− | B2 L+ |
| R2 L+ | G2 L− | B2 L+ | R1 H− | G1 H+ | B1 H− | R2 L− | G2 L+ | B2 L− | R1 H+ | G1 H− | B1 H+ |
| R1 H+ | G1 H− | B1 H+ | R2 L− | G2 L+ | B2 L− | R1 H− | G1 H+ | B1 H− | R2 L+ | G2 L− | B2 L+ |
| R2 L+ | G2 L− | B2 L+ | R1 H− | G2 H+ | B1 H− | R2 L− | G2 L+ | B2 L− | R1 H+ | G1 H− | B1 H+ |

FIG. 5d

| | | | | | | | | | | | |
|---|---|---|---|---|---|---|---|---|---|---|---|
| R1 H+ | G1 H− | B1 H+ | R2 L− | G2 L+ | B2 L− | R1 H− | G1 H+ | B1 H− | R2 L+ | G2 L− | B2 L+ |
| R2 L+ | G2 L− | B2 L+ | R1 H− | G2 H+ | B1 H− | R2 L− | G2 L+ | B2 L− | R1 H+ | G1 H− | B1 H+ |
| R1 H+ | G1 H− | B1 H+ | R2 L− | G2 L | B2 L− | R1 H− | G1 H+ | B1 H− | R2 L+ | G2 L− | B2 L+ |
| R2 L+ | G2 L− | B2 L+ | R1 H− | G1 H+ | B1 H− | R2 L− | G2 L+ | B2 L− | R1 H+ | G1 H− | B1 H+ |
| R1 H+ | G1 H− | B1 H+ | R2 L− | G2 L+ | B2 L− | R1 H− | G1 H+ | B1 H− | R2 L+ | G2 L− | B2 L+ |
| R2 L+ | G2 L− | B2 L+ | R1 H− | G2 H+ | B1 H− | R2 L− | G2 L+ | B2 L− | R1 H+ | G1 H− | B1 H+ |

FIG. 5e

| | | | | | | | | | | | |
|---|---|---|---|---|---|---|---|---|---|---|---|
| R1 H+ | G1 H− | B1 H+ | R2 L− | G2 L+ | B2 L− | R1 H− | G1 H+ | B1 H− | R2 L+ | G2 L− | B2 L+ |
| R2 L+ | G2 L− | B2 L+ | R1 H− | G2 H+ | B1 H− | R2 L− | G2 L+ | B2 L− | R1 H+ | G1 H− | B1 H+ |
| R1 H+ | G1 H− | B1 H+ | R2 L− | G2 L+ | B2 L− | R1 H− | G1 H+ | B1 H− | R2 L+ | G2 L− | B2 L+ |
| R2 L+ | G2 L− | B2 L+ | R1 H− | G2 H+ | B1 H− | R2 L− | G2 L+ | B2 L− | R1 H+ | G1 H− | B1 H+ |
| R1 H+ | G1 H− | B1 H+ | R2 L− | G2 L+ | B2 L− | R1 H− | G1 H+ | B1 H− | R2 L+ | G2 L− | B2 L+ |
| R2 L+ | G2 L− | B2 L+ | R1 H− | G2 H+ | B1 H− | R2 L− | G2 L+ | B2 L− | R1 H+ | G1 H− | B1 H+ |

FIG. 5f

| | | | | | | | | | | | |
|---|---|---|---|---|---|---|---|---|---|---|---|
| R1 H+ | G1 H− | B1 H+ | R2 L− | G2 L+ | B2 L− | R1 H− | G1 H+ | B1 H− | R2 L+ | G2 L− | B2 L+ |
| R2 L+ | G2 L− | B2 L+ | R1 H− | G2 H+ | B1 H− | R2 L− | G2 L+ | B2 L− | R1 H+ | G1 H− | B1 H+ |
| R1 H+ | G1 H− | B1 H+ | R2 L− | G2 L+ | B2 L− | R1 H− | G1 H+ | B1 H− | R2 L+ | G2 L− | B2 L+ |
| R2 L+ | G2 L− | B2 L+ | R1 H− | G2 H+ | B1 H− | R2 L− | G2 L+ | B2 L− | R1 H+ | G1 H− | B1 H+ |
| R1 H+ | G1 H− | B1 H+ | R2 L− | G2 L+ | B2 L− | R1 H− | G1 H+ | B1 H− | R2 L+ | G2 L− | B2 L+ |
| R2 L+ | G2 L− | B2 L+ | R1 H− | G2 H+ | B1 H− | R2 L− | G2 L+ | B2 L− | R1 H+ | G1 H− | B1 H+ |

FIG. 5g

| | | | | | | | | | | | |
|---|---|---|---|---|---|---|---|---|---|---|---|
| R1<br>H+ | G1<br>H− | B1<br>H+ | R2<br>L− | G2<br>L+ | B2<br>L− | R1<br>H− | G1<br>H+ | B1<br>H− | R2<br>L+ | G2<br>L− | B2<br>L+ |
| R2<br>L+ | G2<br>L− | B2<br>L+ | R1<br>H− | G2<br>H+ | B1<br>H− | R2<br>L− | G2<br>L+ | B2<br>L− | R1<br>H+ | G1<br>H− | B1<br>H+ |
| R1<br>H+ | G1<br>H− | B1<br>H+ | R2<br>L− | G2<br>L+ | B2<br>L− | R1<br>H− | G1<br>H+ | B1<br>H− | R2<br>L+ | G2<br>L− | B2<br>L+ |
| R2<br>L+ | G2<br>L− | B2<br>L+ | R1<br>H− | G2<br>H+ | B1<br>H− | R2<br>L− | G2<br>L+ | B2<br>L− | R1<br>H+ | G1<br>H− | B1<br>H+ |
| R1<br>H+ | G1<br>H− | B1<br>H+ | R2<br>L− | G2<br>L+ | B2<br>L− | R1<br>H− | G1<br>H+ | B1<br>H− | R2<br>L+ | G2<br>L− | B2<br>L+ |
| R2<br>L+ | G2<br>L− | B2<br>L+ | R1<br>H− | G2<br>H+ | B1<br>H− | R2<br>L− | G2<br>L+ | B2<br>L− | R1<br>H+ | G1<br>H− | B1<br>H+ |

FIG. 5h

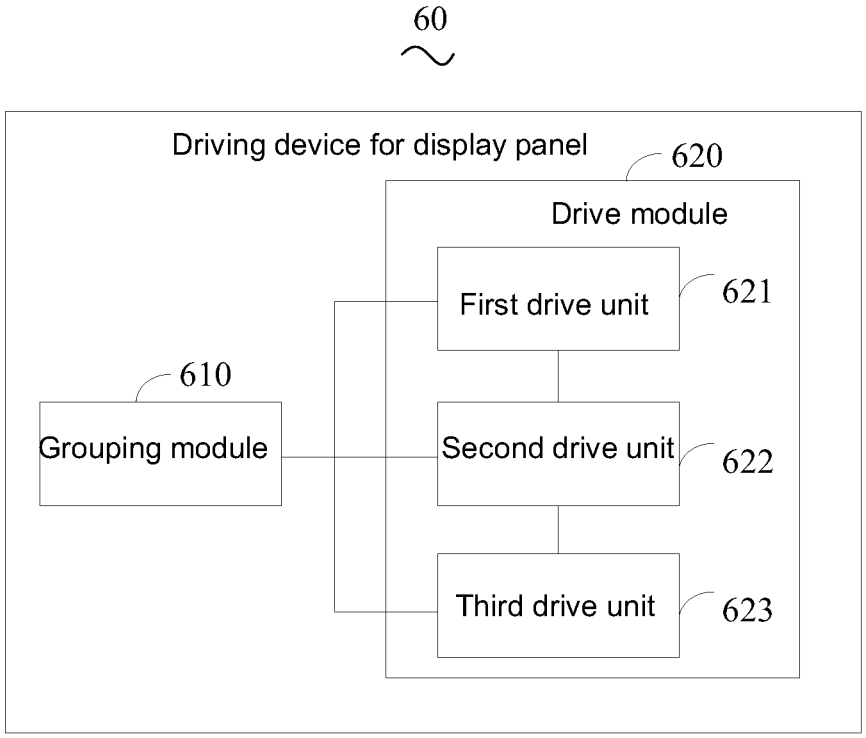

FIG. 6

DRIVING METHOD AND DRIVING DEVICE FOR DISPLAY PANEL, AND DISPLAY DEVICE

FIELD OF THE DISCLOSURE

The disclosure relates to the field of display technologies, and more particularly to a driving method and a driving device for a display panel and a display device.

BACKGROUND

For a traditional vertical alignment (VA) liquid crystal display device, when a picture is displayed, liquid crystal molecules maintain a certain deflection angle, such that transmittances of light under different viewing angles are different, as a result, a color cast phenomenon that a user will feel different colors of the picture when viewing the picture in different viewing angles is caused.

In order to improve the problem of color cast, a common method at present is to divide pixel electrodes of RGB sub-pixels in each pixel unit into two independent pixel electrodes and to apply different drive voltage to the two pixel electrodes respectively to improve the problem of color cast. For the method, since an amount of the pixel electrodes is increased, more metal wires or thin film transistor (TFT) elements need to be redesigned to drive a display panel, but the metal wires and TFT elements are light-shielding, thus this method will scarify a light transmitting aperture region, affects a transmittance of the panel and increases a backlight cost.

In order to avoid the increase of the metal wires or TFT elements, another method is to apply two kinds of high and low drive voltage signals to every two pixel units respectively. Specifically, at a same moment, drive voltages of different polarities are applied to every adjacent two sub-pixels. By adopting such a manner, mismatch of the high voltage positive and negative polarities of a same row of sub-pixels will be caused, that is, an amount of the sub-pixels of a positive polarity high voltage is inconsistent with an amount of the sub-pixels of a negative polarity high voltage. Hence, due to an influence of stray capacitance, when the amount of the sub-pixels of the positive polarity high voltage is more than the amount of the sub-pixels of the negative polarity high voltage, the equivalent voltage of a common voltage $V_{com}$ is improved compared with the original $V_{com}$, as a result, actual charging charges of the sub-pixels of the positive polarity high voltage are increased, and the brightness is increased, and on the contrary, actual charging charges of the sub-pixels of the negative polarity high voltage are increased, and the brightness is reduced, thereby further affecting display colors and a picture quality, and generating the problem of abnormal picture quality output.

SUMMARY

According to respective embodiments of the disclosure, there are provided a driving method and a driving device for a display panel, and a display device, which can prevent a $V_{com}$ voltage from an interference, ensures correctness of an image signal and improves a picture display quality.

The present disclosure provides a driving method for a display panel. The method includes: dividing a plurality of pixel units of the display panel into a plurality of pixel groups, wherein each pixel group includes three columns of continuously arranged pixel units, and the three columns of continuously arranged pixel units include a first position pixel unit, a second position pixel unit and a third position pixel unit respectively, the plurality of pixel units includes a plurality of first pixel units and a plurality of a second pixel units, and each pixel unit includes a plurality of sub-pixels; applying a drive voltage opposite to a polarity of the first position pixel unit to the second position pixel unit and the third position pixel unit in a same pixel group respectively; applying drive voltages of opposite polarities to every adjacent two columns of the sub-pixels in a same column of the pixel units respectively, and applying drive voltages of different voltage levels to the sub-pixels in the first pixel units and the sub-pixels in the second pixel units respectively. Wherein the first pixel units and the second pixel units are adjacently disposed in the display panel.

In one embodiment, applying a drive voltage opposite to a polarity of the first position pixel unit to the second position pixel unit and the third position pixel unit in a same pixel group respectively includes: applying drive voltages of opposite polarities to the first position pixel unit and the second position pixel unit in the same pixel group respectively; and applying a drive voltage same as the polarity of the second position pixel unit to the third position pixel unit in the same pixel group.

In one embodiment, the pixel unit includes a first sub-pixel, a second sub-pixel and a third sub-pixel which are arranged in sequence; applying drive voltages of opposite polarities to the first position pixel unit and the second position pixel unit in the same pixel group respectively; and applying a drive voltage same as the polarity of the second position pixel unit to the third position pixel unit in the same pixel group, includes: in the same pixel group, applying a drive voltage of a first polarity to the first sub-pixel and the third sub-pixel of the first position pixel unit respectively, applying a drive voltage of a second polarity to the first sub-pixel and the third sub-pixel of the second position pixel unit respectively, and applying a drive voltage of a second polarity to the first sub-pixel and the third sub-pixel of the third position pixel unit respectively; and applying a drive voltage of a second polarity to the second sub-pixel of the first position pixel unit, applying a drive voltage of a first polarity to the second sub-pixel of the second position pixel unit, and applying a drive voltage of a first polarity to the second sub-pixel of the third position pixel unit; wherein the first polarity and the second polarity are opposite polarities.

In one embodiment, in every adjacent two frame display time, alternately applying drive voltages of opposite polarities to the same sub-pixel.

In one embodiment, applying drive voltages of different voltage levels to sub-pixels in the first pixel units and sub-pixels in the second pixel units respectively includes: applying the drive voltage of a preset first voltage level to the sub-pixels in the first pixel units; and applying the drive voltage of a preset second voltage level to the sub-pixels in the second pixel units.

In one embodiment, the preset first voltage level and the preset second voltage level are two different values in an array respectively.

In one embodiment, applying a drive voltage opposite to a polarity of the first position pixel unit to the second position pixel unit and the third position pixel unit in a same pixel group respectively includes: applying drive voltages of opposite polarities to the first position pixel unit and the second position pixel unit in the same pixel group respectively; and applying a drive voltage same as the polarity of the second position pixel unit to the third position pixel unit in the same pixel group; wherein the pixel unit includes a first sub-pixel, a second sub-pixel and a third sub-pixel arranged in sequence; applying drive voltages of opposite polarities to the first position pixel unit and the second position pixel unit in the same pixel group respectively; and applying a drive voltage same as the polarity of the second position pixel unit to the third position pixel unit in the same pixel group, includes: in the same pixel group, applying a drive voltage of a first polarity to the first sub-pixel and the third sub-pixel of the first position pixel unit respectively, applying a drive voltage of a second polarity to the first sub-pixel and the third sub-pixel of the second position pixel unit respectively, and applying a drive voltage of a second polarity to the first sub-pixel and the third sub-pixel of the third position pixel unit respectively; and applying a drive voltage of a second polarity to the second sub-pixel of the first position pixel unit, applying a drive voltage of a first polarity to the second sub-pixel of the second position pixel unit, and applying a drive voltage of a first polarity to the second sub-pixel of the third position pixel unit; wherein the first polarity and the second polarity are opposite polarities; and the driving method further includes: in every adjacent two frame display time, alternately applying drive voltages of opposite polarities to the same sub-pixel; wherein applying drive voltages of different voltage levels to sub-pixels in the first pixel units and sub-pixels in the second pixel units respectively includes: applying the drive voltage of a preset first voltage level to the sub-pixels in the first pixel units; and applying the drive voltage of a preset second voltage level to the sub-pixels in the second pixel units.

The present disclosure also provides a driving device for a display panel. The driving device includes: a grouping module, configured for dividing a plurality of pixel units of the display panel into a plurality of pixel groups, such that each pixel group includes three columns of continuously arranged pixel units, and the three columns of continuously arranged pixel units are a first position pixel unit, a second position pixel unit and a third position pixel unit respectively, the plurality of pixel units includes a plurality of first pixel units and a plurality of a second pixel units, and each pixel unit includes a plurality of sub-pixels; a drive module, including a first drive unit, a second drive unit and a third drive unit; wherein the first drive unit is configured for applying a drive voltage opposite to a polarity of the first position pixel unit to the second position pixel unit and the third position pixel unit in a same pixel group respectively; the second drive unit is configured for applying drive voltages of opposite polarities to every adjacent two columns of the sub-pixels in a same column of the pixel units respectively; and the third drive unit is configured for applying drive voltages of different voltage levels to the sub-pixels in the first pixel units and the sub-pixels in the second pixel units respectively. Wherein the first pixel units and the second pixel units are adjacently disposed in the display panel.

In one embodiment, the first drive unit is further configured for applying drive voltages of opposite polarities to the first position pixel unit and the second position pixel unit in the same pixel group respectively; and applying a drive voltage same as the polarity of the second position pixel unit to the third position pixel unit in the same pixel group.

In one embodiment, the pixel unit includes a first sub-pixel, a second sub-pixel and a third sub-pixel which are arranged in sequence; the first drive unit includes: a first drive subunit, configured for, in the same pixel group, applying a drive voltage of a first polarity to the first sub-pixel and the third sub-pixel of the first position pixel unit respectively, applying a drive voltage of a second polarity to the first sub-pixel and the third sub-pixel of the second position pixel unit respectively, and applying a drive voltage of a second polarity to the first sub-pixel and the third sub-pixel of the third position pixel unit respectively; and a second drive subunit, configured for applying a drive voltage of a second polarity to the second sub-pixel of the first position pixel unit, applying a drive voltage of a first polarity to the second sub-pixel of the second position pixel unit, and applying a drive voltage of a first polarity to the second sub-pixel of the third position pixel unit; wherein the first polarity and the second polarity are opposite polarities.

In one embodiment, the drive module further includes a fourth drive unit, configured for, in every adjacent two frame display time, alternately applying drive voltages of opposite polarities to the same sub-pixel.

In one embodiment, applying drive voltages of different voltage levels to the sub-pixels in the first pixel units and the sub-pixels in the second pixel units respectively includes: applying the drive voltage of a preset first voltage level to the sub-pixels in the first pixel units; and applying the drive voltage of a preset second voltage level to the sub-pixels in the second pixel units.

In one embodiment, the preset first voltage level and the preset second voltage level are two different values in an array respectively.

In one embodiment, the first drive unit is further configured for applying drive voltages of opposite polarities to the first position pixel unit and the second position pixel unit in the same pixel group respectively; and applying a drive voltage same as the polarity of the second position pixel unit to the third position pixel unit in the same pixel group; the pixel unit includes a first sub-pixel, a second sub-pixel and a third sub-pixel arranged in sequence; and the first drive unit includes: a first drive subunit, configured for, in the same pixel group, applying a drive voltage of a first polarity to the first sub-pixel and the third sub-pixel of the first position pixel unit respectively, applying a drive voltage of a second polarity to the first sub-pixel and the third sub-pixel of the second position pixel unit respectively, and applying a drive voltage of a second polarity to the first sub-pixel and the third sub-pixel of the third position pixel unit respectively; wherein applying drive voltages of different voltage levels to the sub-pixels in the first pixel units and the sub-pixels in the second pixel units respectively includes applying the drive voltage of a preset first voltage level to the sub-pixels in the first pixel units; and applying the drive voltage of a preset second voltage level to the sub-pixels in the second pixel units; a second drive subunit, configured for applying a drive voltage of a second polarity to the second sub-pixel of the first position pixel unit, applying a drive voltage of a first polarity to the second sub-pixel of the second position pixel unit, and applying a drive voltage of a first polarity to the second sub-pixel of the third position pixel unit; wherein the first polarity and the second polarity are opposite polarities; the drive module further includes: a fourth drive unit, configured for, in every adjacent two frame display time, alternately applying drive voltages of opposite polarities to the same sub-pixel.

The present disclosure also provides a display device. The display device including a display panel and an above driving device connected to the display panel.

According to the above driving method and driving device for a display panel, and a display device, an amount of sub-pixels applied with a positive polarity high voltage level drive voltage equals to an amount of sub-pixels applied with a negative polarity high voltage level drive voltage, such that the $V_{com}$ voltage is prevented from affected by stray capacitance, thereby ensuring correctness of an image signal and avoiding a phenomenon of color cast or abnormal picture quality.

BRIEF DESCRIPTION OF THE DRAWINGS

In order to more clearly explain technical solutions of present disclosure or prior art, the drawings required in description of the embodiments or the prior art will be briefly introduced. It is obvious that the described drawings below are some embodiments of the present disclosure, and those ordinary skilled in the art can acquire other drawings according to these drawings, without paying any inventive work.

FIG. 3 is a schematic view of drive voltages for respective sub-pixels in a plurality of pixel units of a display panel according to one embodiment.

FIG. 4 is a schematic view of a drive voltage for respective sub-pixels in a plurality of pixel units of a display panel according to another embodiment.

FIG. 5*a* is a schematic view of drive voltages for a plurality of pixel units when a display panel displays a specific picture according to one embodiment.

FIG. 5*b* is a schematic view of drive voltages for a plurality of pixel units when a display panel displays another specific picture according to one embodiment.

FIG. 5*c* is a schematic view of drive voltages for a plurality of pixel units when a display panel displays yet another specific picture according to one embodiment.

FIG. 5*d* is a schematic view of drive voltages for a plurality of pixel units when a display panel displays still a further specific picture according to one embodiment.

FIG. 5*e* is a schematic view of drive voltages for a plurality of pixel units when a display panel displays one more specific picture according to one embodiment.

FIG. 5*f* is a schematic view of drive voltages for a plurality of pixel units when a display panel displays one additional specific picture according to one embodiment.

FIG. 5*g* is a schematic view of drive voltages for a plurality of pixel units when a display panel displays one more specific picture according to one embodiment.

FIG. 5*h* is a schematic view of drive voltages for a plurality of pixel units when a display panel displays one additional specific picture according to one embodiment.

FIG. 6 is a structural schematic view of a driving device for a display panel according to an embodiment.

DETAILED DESCRIPTION OF PREFERRED EMBODIMENTS

Figures 1, 2:
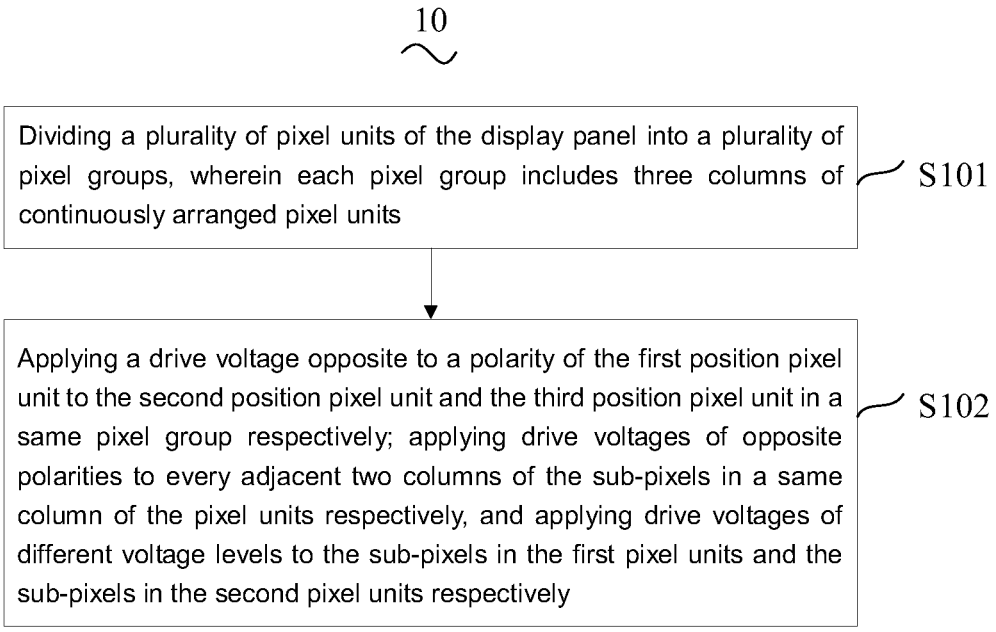
FIG. 1 is a flow schematic view of a driving method for a display panel according to one embodiment.
FIG. 2 is a schematic view of drive voltages for a plurality of pixel units of a display panel according to one embodiment.

The specific structural and functional details disclosed herein are only representative and are intended for describing exemplary embodiments of the disclosure. However, the disclosure can be embodied in many forms of substitution, and should not be interpreted as merely limited to the embodiments described herein.

In the description of the disclosure, terms used herein are only for illustrating concrete embodiments rather than limiting the exemplary embodiments. Unless otherwise indicated in the content, singular forms "a" and "an" also include plural. Moreover, the terms "comprise" and/or "include" define the existence of described features, integers, steps, operations, units and/or components, but do not exclude the existence or addition of one or more other features, integers, steps, operations, units, components and/or combinations thereof.

For example, according to a driving method for a display panel, the display panel has a plurality of pixel units distributed in a matrix, wherein the plurality of pixel units include a plurality of first pixel units and a plurality of a second pixel units, the first pixel units and the second pixel units are disposed adjacently, and each pixel unit includes a plurality of sub-pixels, the driving method includes dividing a plurality of pixel units of the display panel into a plurality of pixel groups, wherein each pixel group includes three columns of continuously arranged pixel units, and the three columns of continuously arranged pixel units are a first position pixel unit, a second position pixel unit and a third position pixel unit respectively, the plurality of pixel units comprises a plurality of first pixel units and a plurality of a second pixel units, and each pixel unit comprises a plurality of sub-pixels; applying a drive voltage opposite to a polarity of the first position pixel unit to the second position pixel unit and the third position pixel unit in a same pixel group respectively; applying drive voltages of opposite polarities to every adjacent two columns of the sub-pixels in a same column of the pixel units respectively, and applying drive voltages of different voltage levels to the sub-pixels in the first pixel units and the sub-pixels in the second pixel units respectively. Or the drive voltage is applied to each sub-pixel in the display panel, such that the polarities of the drive voltages for the second position pixel unit and the third position pixel unit in a same pixel group are opposite to the polarity of the drive voltage for the first position pixel unit; the polarities of the drive voltages for every adjacent two columns of sub-pixels in a same column of pixel units are opposite; and the voltage levels of the drive voltages for the sub-pixels in the first pixel units and the voltage levels of the drive voltages for the sub-pixels in the second pixel units are different. Wherein the first pixel units and the second pixel units are adjacently disposed in the display panel. That is to say, the display panel has a plurality of pixel units distributed in a matrix, the plurality of pixel units include the first pixel units and the second pixel units disposed adjacently, and these plurality of pixel units are divided into a plurality of pixel groups, and each pixel group includes three columns of continuously arranged pixel units.

For example, a driving device for a display panel, the display panel has a plurality of a pixel units distributed in a matrix, wherein the plurality of pixel units include a plurality of first pixel units and a plurality of a second pixel units, the first pixel units and the second pixel units are disposed adjacently, and each pixel unit includes a plurality of sub-pixels, the driving device includes a grouping module and a drive module, the drive module includes a first drive unit, a second drive unit and a third drive unit; the grouping module is configured for dividing a plurality of pixel units of the display panel into a plurality of pixel groups, such that each pixel group includes three columns of continuously arranged pixel units, and the three columns of continuously arranged pixel units are a first position pixel unit, a second position pixel unit and a third position pixel unit respectively, the plurality of pixel units comprises a plurality of first pixel units and a plurality of a second pixel units, and each pixel unit comprises a plurality of sub-pixels; the first drive unit is configured for applying a drive voltage opposite to a polarity of the first position pixel unit to the second position pixel unit and the third position pixel unit in a same pixel group respectively; the second drive unit is configured for applying drive voltages of opposite polarities to every adjacent two columns of the sub-pixels in a same column of the pixel units respectively; and the third drive unit is configured for applying drive voltages of different voltage levels to the sub-pixels in the first pixel units and the sub-pixels in the second pixel units respectively; wherein the first pixel units and the second pixel units are adjacently disposed in the display panel.

For example, a display device includes a display panel and the driving device for a display panel according to any above embodiment.

In order to further understand the driving method and driving device for a display panel and the display device. The drawings are combined below for explanation.

Referring to FIGS. 1 to 3, FIG. 1 is a flow schematic view of a driving method for a display panel according to one embodiment, and the driving method is applied to the display panel. As shown in FIG. 1, the driving method 10 includes the following steps.

S101 dividing a plurality of pixel units of the display panel into a plurality of pixel groups, wherein each pixel group includes three columns of continuously arranged pixel units.

Wherein the three columns of continuously arranged pixel units are a first position pixel unit, a second position pixel unit and a third position pixel unit respectively, the plurality of pixel units comprises a plurality of first pixel units and a plurality of a second pixel units, and each pixel unit comprises a plurality of sub-pixels.

Wherein the second position pixel unit is located between the first position pixel unit and the third position pixel unit. For example, the three columns of continuously arranged pixel units are a first position pixel unit, a second position pixel unit and a third position pixel unit respectively in a sequence from left to right. For another example, the three columns of continuously arranged pixel units are a first position pixel unit, a second position pixel unit and a third position pixel unit respectively in a sequence from right to left. For another example, the three columns of continuously arranged pixel units are a first position pixel unit, a second position pixel unit and a third position pixel unit respectively in a sequence from top to bottom. For another example, the three columns of continuously arranged pixel units are a first position pixel unit, a second position pixel unit and a third position pixel unit respectively in a sequence from bottom to top.

In some embodiments, the pixels may be arranged according to a column direction, or arranged according to a row direction. It should be explained that according to the embodiments of the disclosure, the column presents a longitudinal direction, and the row represents a transverse direction.

S102 applying a drive voltage opposite to a polarity of the first position pixel unit to the second position pixel unit and the third position pixel unit in a same pixel group respectively; applying drive voltages of opposite polarities to every adjacent two columns of the sub-pixels in a same column of the pixel units respectively, and applying drive voltages of different voltage levels to the sub-pixels in the first pixel units and the sub-pixels in the second pixel units respectively.

For example, the drive voltage is applied to each sub-pixel in the display panel, such that the polarities of the drive voltages for the second position pixel unit and the third position pixel unit in a pixel group are opposite to the polarity of the drive voltage for the first position pixel unit; the polarities of the drive voltages for every adjacent two columns of sub-pixels in a same column of pixel units are opposite; and the voltage levels of the drive voltages for the sub-pixels in the first pixel units and the voltage levels of the drive voltages for the sub-pixels in the second pixel units are different, wherein the different voltage levels include a preset high voltage level and a preset low voltage level. In this way, in each row of pixels of the display panel, an amount of the sub-pixels applied with a positive polarity drive voltage of a high voltage level equals to an amount of the sub-pixels applied with a negative polarity drive voltage of a high voltage level, such that the $V_{com}$ voltage is prevented from affected by stray capacitance, thereby ensuring correctness of an image signal and avoiding a phenomenon of color cast or abnormal picture quality. It should be noted that in the embodiments of the disclosure, the column presents a longitudinal direction, and the row represents a transverse direction.

Wherein the first pixel units and the second pixel units are adjacently disposed in the display panel. As shown in FIG. 2, the display panel 20 has a plurality of pixel units distributed in a matrix, the plurality of pixel units include a plurality of first pixel units P1 and a plurality of second pixel units P2, and the first pixel units and the second pixel units are disposed adjacently. In other words, the first pixel units and the second pixel units are arranged alternately. For example, as shown in FIG. 2, the pixel units adjacent to the first pixel units are all second pixel units, and the pixel units adjacent to the second pixel units are all first pixel units. Specifically, each pixel unit includes a plurality of sub-pixels, for example, each pixel unit includes a plurality of sub-pixels of different colors, for another example, each pixel unit includes a red sub-pixel R, a green sub-pixel G and a blue sub-pixel B respectively. As shown in FIG. 2, the 6 columns of pixel units from a jth column to a (j+5)th column are divided into two pixel groups which are a nth pixel group and a (n+1) pixel group respectively, each pixel group includes three columns of continuously arranged pixel units, for example, the nth pixel group includes continuously arranged jth to (j+2)th columns of pixel units, the (n+1) pixel group includes continuously arranged (j+3)th to (j+5)th columns of pixel units. Wherein (i, j) represents the ith row and jth column, (i, j+1) represents the ith row and (j+1)th column, (i+1, j) represents the (i+1)th row and jth column, and so on.

By taking the nth pixel group as an example, as shown in FIG. 3, the nth pixel group include a first position pixel unit $P_j$, a second position pixel unit $P_{j+1}$ and a third position pixel unit $P_{j+2}$. R1, G1 and B1 represent a red sub-pixel, a green sub-pixel and a blue sub-pixel in the first pixel unit respectively. R2, G2 and B2 represent a red sub-pixel, a green sub-pixel and a blue sub-pixel in the second pixel unit respectively. H represents a first voltage level, L represents a second voltage level, + represents positive polarity, and − represents negative polarity. Wherein, (i, j) represents the ith row and jth column, (i, j+1) represents the ith row and (j+1)th column, (i+1, j) represents the (i+1)th row and jth column, and so on.

According to the above driving method, a drive voltage opposite to a polarity of the first position pixel unit is applied to the second position pixel unit and the third position pixel unit in a same pixel group respectively. For example, the drive voltages of opposite polarities are applied to the first position pixel unit and the second position pixel unit in the same pixel group respectively; and a drive voltage same as the polarity of the second position pixel unit is applied to the third position pixel unit in the same pixel group. For another example, in the same pixel group, the drive voltage of a first polarity is applied to the first sub-pixel and the third sub-pixel of the first position pixel unit, the drive voltage of a second polarity is applied to the first sub-pixel and the third sub-pixel of the second position pixel unit, and the drive voltage of the second polarity is applied to the first sub-pixel and the third sub-pixel of the third position pixel unit. The drive voltage of the second polarity is applied to the second sub-pixel of the first position pixel unit, the drive voltage of the first polarity is applied to the second sub-pixel of the second position pixel unit, and the drive voltage of the first polarity is applied to the second sub-pixel of the third position pixel unit, wherein the first polarity and the second polarity are opposite polarities, for example, the first polarity is positive polarity, and the second polarity is negative polarity, or the first polarity is negative polarity, and the second polarity is positive polarity. In the present embodiment, the positive polarity refers to that a size of the drive voltage is larger than a preset common voltage $V_{com}$ of the display panel, that is, a voltage difference between the drive voltage and the $V_{com}$ is larger than 0. The negative polarity refers to that a size of the drive voltage is smaller than a preset common voltage $V_{com}$, that is, a voltage difference between the drive voltage and the $V_{com}$ is smaller than 0.

As shown in FIG. 3, by taking the nth pixel group as an example, the drive voltages of positive polarity, negative polarity and positive polarity are applied to the R sub-pixel, the G sub-pixel and the B sub-pixel of the first position pixel unit $P_j$, the drive voltages of negative polarity, positive polarity and negative polarity are applied to the R sub-pixel, the G sub-pixel and the B sub-pixel of the second position pixel unit $P_{j+1}$, and the drive voltages of negative polarity, positive polarity and negative polarity are applied to the R sub-pixel, the G sub-pixel and the B sub-pixel of the third position pixel unit $P_{j+2}$, such that the polarity of the drive voltage of the first position pixel unit $P_j$ is opposite to the polarity of the drive voltage of the second position pixel unit $P_{j+i}$, and the polarity of the drive voltage of the third position pixel unit $P_{j+2}$ is opposite to the polarity of the drive voltage of the second position pixel unit $P_{j+1}$.

According to the above driving method, the drive voltages of opposite polarities are applied to every adjacent two columns of sub-pixels in a same column of pixel units respectively. For example, the drive voltages of the same polarity are applied to the first sub-pixels and the third sub-pixels in the same column of pixel units, and the drive voltage opposite to the polarity of the first sub-pixels is applied to the second sub-pixels in the same column of pixel units. For another example, as shown in FIG. 3, the R sub-pixel, the G sub-pixel and the B sub-pixel in each pixel unit are arranged in sequence, by taking the jth column as an example, the drive voltage of negative polarity is applied to the G sub-pixels, and the drive voltage of positive polarity are applied to the R sub-pixels and the B sub-pixels respectively, such that the polarities of the drive voltages of every adjacent two columns of two sub-pixels in the same column are opposite.

According to the above driving method, drive voltages of different voltage levels are applied to sub-pixels in first pixel units and sub-pixels in second pixel units respectively. For example, the drive voltage levels respectively corresponding to the first pixel units and the second pixel units are preset respectively, and for another example, a first drive voltage level corresponding to the first pixel units and a second drive voltage level corresponding to the second pixel units are preset.

As an embodiment, the drive voltage of the preset first voltage level is applied to the sub-pixels in the first pixel units; and the drive voltage of a preset second voltage level is applied to the sub-pixels in the second pixel units. Wherein in the first drive voltage level and the second drive voltage level, one is a high voltage level and the other is a low voltage level. For example, the first drive voltage level is higher than the second drive voltage level, or the first drive voltage level is lower than the second drive voltage level. As an embodiment, the preset first drive voltage level and the preset second drive voltage level are two different values in an array respectively. For example, the array is a preset drive voltage level array, and contains a plurality of different drive voltage levels, and the preset first drive voltage level and the preset second drive voltage level are two different drive voltage levels in the preset drive voltage level array. As an embodiment, the first drive voltage level and the second drive voltage level are interchanged once every a preset time period, that is, every time period or every preset time period, the first drive voltage level and the second drive voltage level are updated, the first drive voltage level is set to be the original second drive voltage level, and the second drive voltage level is set to be the original first drive voltage level, in this way, on the basis that a gray scale brightness curve of the pixel unit under a side viewing angle is close to the gray scale brightness curve under a front viewing angle, long term operation is further ensured to achieve a uniform display effect. Further, the preset time period is set or adjusted according to adjacent two frame display time, or the preset time period is set or adjusted according to a frame frequency, that is to say, for different frame frequencies, the preset time period is different, thus, it can be ensured that the display panels of different display purposes have proper preset time periods. Therefore, the display of the display panel can be adapted when the first drive voltage level and the second drive voltage level are adjusted. Further, the preset time period is in direct proportion to the adjacent two frame display time, or the preset time period is in inverse proportion to the frame frequency of the display panel. For example, the longer the adjacent two frame display time is, the longer the preset time period is, or the larger the frame frequency is, the smaller the preset time period is, and so on. Further, the driving method further includes presetting the preset time period. Further, the driving method further includes presetting an amplitude of variation coefficient range. Besides, interchanging the first drive voltage level and the second drive voltage level once ever preset time period includes interchanging the first drive voltage level and the second drive voltage level once ever preset time period and in the interchanging process, and randomly obtaining an amplitude of variation coefficient according to the amplitude of variation range. For example, every preset time period, the first drive voltage level and the second drive voltage level are updated, the first drive voltage level is set to be a product of the original second drive voltage level multiplied by an amplitude of variation coefficient randomly obtained from the amplitude of variation coefficient range, and the second drive voltage level is set to be a product of the original first drive voltage level multiplied by an amplitude of variation coefficient randomly obtained from the amplitude of variation coefficient range. For example, in the interchanging process, the two amplitude of variation coefficients are same or different. For example, every preset time period, the first drive voltage level and the second drive voltage level are updated, the amplitude of variation coefficient is randomly obtained from the amplitude of variation coefficient range, the first drive voltage level is set to be a product of the original second drive voltage level multiplied by the amplitude of variation coefficient, and the second drive voltage level is set to be a product of the original first drive voltage level multiplied by the amplitude of variation coefficient. It is understandable that different voltage levels correspond to different drive voltages. In this way, on the basis that a gray scale brightness curve of the pixel unit under a side viewing angle is close to the gray scale brightness curve under a front viewing angle, long term operation is further ensured to achieve a uniform display effect, better protection for the display panel is formed, and such design is favorable for improving a picture display quality.

By adopting the above driving method, in each row of pixels of the display panel, an amount of the sub-pixels applied with a positive polarity high voltage level (H+) equals to an amount of the sub-pixels applied with a negative polarity high voltage level (H−), for example, in each row in FIG. 3, there are 3 sub-pixels applied with a positive polarity high voltage level (H+) and 3 sub-pixels applied with a negative polarity high voltage level respectively. Due to the same amount of the sub-pixels of the high voltage level positive and negative polarities, the $V_{com}$ voltage is prevented from being affected by stray capacitance, thereby ensuring correctness of an image signal, and avoiding a phenomenon of color cast or abnormal picture quality.

In one embodiment, the above driving method further includes applying the driving voltage of the same polarity to a same column of sub-pixels. In this way, differences among a plurality of voltage signals output by a same data line are kept within a smaller range, and heating of a data drive chip or distortion of the voltage signal can be avoided, thereby further improving display quality of respective sub-pixels.

In one embodiment, in the driving method, applying a drive voltage opposite to a polarity of the first position pixel unit to the second position pixel unit and the third position pixel unit in a same pixel group respectively includes applying drive voltages of opposite polarities to the first position pixel unit and the second position pixel unit in the same pixel group respectively; and applying a drive voltage same as the polarity of the second position pixel unit to the third position pixel unit in the same pixel group. Wherein the pixel unit includes a first sub-pixel, a second sub-pixel and a third sub-pixel arranged in sequence; applying drive voltages of opposite polarities to the first position pixel unit and the second position pixel unit in the same pixel group respectively; and applying a drive voltage same as the polarity of the second position pixel unit to the third position pixel unit in the same pixel group, includes applying a drive voltage of a first polarity to the first sub-pixel and the third sub-pixel of the first position pixel unit respectively, applying a drive voltage of a second polarity to the first sub-pixel and the third sub-pixel of the second position pixel unit respectively, and applying a drive voltage of a second polarity to the first sub-pixel and the third sub-pixel of the third position pixel unit respectively; and applying a drive voltage of a second polarity to the second sub-pixel of the first position pixel unit, applying a drive voltage of a first polarity to the second sub-pixel of the second position pixel unit, and applying a drive voltage of a first polarity to the second sub-pixel of the third position pixel unit; wherein the first polarity and the second polarity are opposite polarities. Besides, the driving method further includes, in every adjacent two frame display time, alternately applying drive voltages of opposite polarities to the same sub-pixel; wherein applying drive voltages of different voltage levels to the sub-pixels in the first pixel units and the sub-pixels in the second pixel units respectively includes applying the drive voltage of a preset first voltage level to the sub-pixels in the first pixel units; and applying the drive voltage of a preset second voltage level to the sub-pixels in the second pixel units.

In actual application, when the display panel is a liquid crystal panel, considering that if liquid crystal pixels are driven by a DC electric field, chemical reaction of a liquid crystal material is easily caused, and electrode ageing is accelerated, and further a service life of the display panel is shortened. In one embodiment, the display panel is a liquid crystal panel. Therefore, in one embodiment, in order to protect the liquid crystal material and electrodes and prolong the service life of the display panel, each sub-pixel in the display panel is driven by an alternating current. Specifically, for the same sub-pixel, in every adjacent two frame display time, the drive voltages of opposite polarities are applied respectively to achieve the AC driving effect. For example, the driving method further includes, in every adjacent two frame display time, alternately applying drive voltages of opposite polarities to the same sub-pixel, or for each sub-pixel, in each frame display time, the drive voltage opposite to the polarity of the last display time is applied. For example, in mth frame display time, the drive voltage as shown in FIG. 3 is applied to some sub-pixels in the display panel, while in (m+1)th frame display time, the drive voltage as shown in FIG. 4 is applied to some sub-pixels in the display panel. It can be seen that in every adjacent two frame display time, the polarity of the drive voltage of the same sub-pixel is changed, and the drive voltage level is kept unchanged.

As an embodiment, when the display panel is driven, for each sub-pixel, according to the drive voltage level of the pixel unit to which each sub-pixel belongs, the polarity of the drive voltage is determined according to an arrangement sequence in the pixel unit and an arrangement sequence of the pixel unit in the pixel group, and further the drive voltage of each sub-pixel is obtained according to image data of each sub-pixel and the corresponding polarity and level of the drive voltage, and the drive voltage is applied to each sub-pixel by a data line.

By adopting the above driving method for a display panel, the display panel is driven to display several specific test pictures as shown in FIGS. 5*a*, 5*b*, 5*c*, 5*d*, 5*e*, 5*f*, 5*g* and 5*h* respectively, the sub-pixels filled with black oblique lines represent that data signals corresponding to the sub-pixels are dark signals. After experiment, it is found that the display from flicker pictures of FIGS. 5*a* and 5*b* to the picture of FIG. 5*h* all have no problem of color cast, the picture of FIG. 5*c* can avoid crosstalk in a horizontal direction, FIG. 5*d* has no problem of color cast, wherein FIG. 5*d* represents a picture in alternately bright/dark display every other pixel unit, FIG. 5*e* represents a picture in alternately bright/dark every display other two pixel units, FIG. 5*f* represents a picture in alternately bright/dark display every other sub-pixel, FIG. 5*g* represents a picture in alternately bright/dark display every other one row of sub-pixels, and FIG. 5*h* represents a picture in alternately bright/dark display every other one row of pixel units. Thus it can be seen that the driving method for a display panel according to the embodiment of the disclosure has better improvement effect for color cast.

The embodiment of the disclosure further provides a driving device 60 for a display panel. The display panel has a plurality of pixel units distributed in a matrix, wherein the pixel units include a plurality of first pixel units and a plurality of second pixel units, the first pixel units and the second pixel units are disposed adjacently, each pixel unit includes a plurality of sub-pixels.

As shown in FIG. 6, the driving device 60 includes a grouping module 610 and a drive module 620, wherein the drive module 620 includes a first drive unit 621, a second drive unit 622 and a third drive unit 623. The grouping module 610 is configured for dividing a plurality of pixel units of the display panel into a plurality of pixel groups, such that each pixel group includes three columns of continuously arranged pixel units, and the three columns of continuously arranged pixel units are a first position pixel unit, a second position pixel unit and a third position pixel unit respectively, the plurality of pixel units comprises a plurality of first pixel units and a plurality of a second pixel units, and each pixel unit comprises a plurality of sub-pixels; the first drive unit 621 is configured for applying a drive voltage opposite to a polarity of the first position pixel unit to the second position pixel unit and the third position pixel unit in a same pixel group respectively; the second drive unit 622 is configured for applying drive voltages of opposite polarities to every adjacent two columns of the sub-pixels in a same column of the pixel units respectively; and the third drive unit 623 is configured for applying drive voltages of different voltage levels to the sub-pixels in the first pixel units and the sub-pixels in the second pixel units respectively. For example, the first drive unit 621 is configured for applying drive voltages of opposite polarities to the first position pixel unit and the second position pixel unit in the same pixel group respectively; and applying a drive voltage same as the polarity of the second position pixel unit to the third position pixel unit in the same pixel group. As an embodiment, applying drive voltages of different voltage levels to the sub-pixels in the first pixel units and the sub-pixels in the second pixel units respectively includes applying the drive voltage of a preset first voltage level to the sub-pixels in the first pixel units; and applying the drive voltage of a preset second voltage level to the sub-pixels in the second pixel units. As an embodiment, the preset first voltage level and the preset second voltage level are two different values in an array respectively. For example, the array is a preset drive voltage level array, and contains a plurality of different drive voltage levels, and the preset first drive voltage level and the preset second drive voltage level are two different drive voltage levels in the preset drive voltage level array.

For another example, the pixel unit includes a first sub-pixel, a second sub-pixel and a third sub-pixel which are arranged in sequence; the first drive unit includes a first drive subunit, a second drive subunit and a third drive subunit. The first drive subunit is disposed in the same pixel group and configured for applying a drive voltage of a first polarity to the first sub-pixel and the third sub-pixel of the first position pixel unit respectively, applying a drive voltage of a second polarity to the first sub-pixel and the third sub-pixel of the second position pixel unit respectively, and applying a drive voltage of a second polarity to the first sub-pixel and the third sub-pixel of the third position pixel unit respectively; and the second drive subunit is configured for applying a drive voltage of a second polarity to the second sub-pixel of the first position pixel unit, applying a drive voltage of a first polarity to the second sub-pixel of the second position pixel unit, and applying a drive voltage of a first polarity to the second sub-pixel of the third position pixel unit; wherein the first polarity and the second polarity are opposite polarities.

Thus, in each row, an amount of the sub-pixels applied with a positive polarity high voltage level (H+) equals to an amount of the sub-pixels applied with a negative polarity high voltage level (H−), such that the $V_{com}$ voltage is prevented from being affected by stray capacitance, thereby ensuring correctness of an image signal, and avoiding a phenomenon of color cast or abnormal picture quality.

Wherein the column and row in the embodiment of the disclosure represent two arrangement directions vertical to each other, for example, the column represents a longitudinal direction and the row represents a transverse direction; and for another example, the column represents the transverse direction and the row represents the longitudinal direction. That is, the column in the embodiment of the disclosure may be the row understood by those ordinary skilled in the art, and the row in the embodiment of the disclosure may be the column understood by those ordinary skilled in the art.

In one of the embodiments, the drive module further includes a fourth drive unit, configured for, in every adjacent two frame display time, alternately applying drive voltages of opposite polarities to the same sub-pixel. In this way, respective sub-pixels can be driven by alternating current, thereby protecting a crystal liquid crystal material and electrodes and prolonging a service life of the display panel.

In one of the embodiments, the third drive unit is specifically configured for applying the drive voltage of a preset first voltage level to the sub-pixels in the first pixel units; and applying the drive voltage of a preset second voltage level to the sub-pixels in the second pixel units. In this way, it can be ensured that the drive voltage levels of every adjacent two pixel units are different, and the polarities of the drive voltages of the sub-pixels in every adjacent two sub-pixel groups are opposite.

In one of the embodiments, in the driving device, the first drive unit is further configured for applying drive voltages of opposite polarities to the first position pixel unit and the second position pixel unit in the same pixel group respectively; and applying a drive voltage same as the polarity of the second position pixel unit to the third position pixel unit in the same pixel group; the pixel unit includes a first sub-pixel, a second sub-pixel and a third sub-pixel arranged in sequence; and the first drive unit includes a first drive subunit, configured for, in the same pixel group, applying a drive voltage of a first polarity to the first sub-pixel and the third sub-pixel of the first position pixel unit respectively, applying a drive voltage of a second polarity to the first sub-pixel and the third sub-pixel of the second position pixel unit respectively, and applying a drive voltage of a second polarity to the first sub-pixel and the third sub-pixel of the third position pixel unit respectively; wherein applying drive voltages of different voltage levels to the sub-pixels in the first pixel units and the sub-pixels in the second pixel units respectively includes applying the drive voltage of a preset first voltage level to the sub-pixels in the first pixel units; and applying the drive voltage of a preset second voltage level to the sub-pixels in the second pixel units; a second drive subunit, configured for applying a drive voltage of a second polarity to the second sub-pixel of the first position pixel unit, applying a drive voltage of a first polarity to the second sub-pixel of the second position pixel unit, and applying a drive voltage of a first polarity to the second sub-pixel of the third position pixel unit; wherein the first polarity and the second polarity are opposite polarities; the drive module further includes a fourth drive unit, configured for, in every adjacent two frame display time, alternately applying drive voltages of opposite polarities to the same sub-pixel.

In one of the embodiments, the driving device further includes an interchanging unit, connected to the drive module; the interchanging unit is configured for interchanging the first drive voltage level and the second drive voltage level once every a preset time period, that is, the interchanging unit is configured for, every time period or every preset time period, updating the first drive voltage level and the second drive voltage level, setting the first drive voltage level to be the original second drive voltage level and setting the second drive voltage level to be the original first drive voltage level, in this way, on the basis that a gray scale brightness curve of the pixel unit under a side viewing angle is close to the gray scale brightness curve under a front viewing angle, long term operation is further ensured to achieve a uniform display effect. Further, the preset time period is set or adjusted according to adjacent two frame display time, or the preset time period is set or adjusted according to a frame frequency. Further, the preset time period is in direct proportion to the adjacent two frame display time, or the preset time period is in inverse proportion to the frame frequency of the display panel. For example, the longer the adjacent two frame display time is, the longer the preset time period is, or the larger the frame frequency is, the smaller the preset time period is, and so on, that is to say, for different frame frequencies, the preset time period is different, thus, it can be ensured that the display panels of different display purposes have proper preset time periods. Therefore, the display of the display panel can be adapted when the first drive voltage level and the second drive voltage level are adjusted. Further the interchanging unit is configured for presetting the preset time period. Further the interchanging unit is configured for presetting an amplitude of variation coefficient range. Interchanging the first drive voltage level and the second drive voltage level once every a preset time period includes interchanging the first drive voltage level and the second drive voltage level once every a preset time period and randomly obtaining an amplitude of variation coefficient according to the amplitude of variation coefficient range in the interchanging process; for example, every preset time period, the first drive voltage level and the second drive voltage level are updated, the first drive voltage level is set to be a product of the original second drive voltage level multiplied by an amplitude of variation coefficient randomly obtained from the amplitude of variation coefficient range, and the second drive voltage level is set to be a product of the original first drive voltage level multiplied by an amplitude of variation coefficient randomly obtained from the amplitude of variation coefficient range. For example, the interchanging unit is further configured for setting the two amplitude of variation coefficients to be same or different in the interchanging process. For example, every preset time period, the first drive voltage level and the second drive voltage level are updated, an amplitude of variation coefficient is randomly obtained from the amplitude of variation coefficient range, the first drive voltage level is set to be a product of the original second drive voltage level multiplied by the amplitude of variation coefficient, and the second drive voltage level is set to be a product of the original first drive voltage level multiplied by the amplitude of variation coefficient. It is understandable that different voltages correspond to different drive voltages. In this way, on the basis that a gray scale brightness curve of the pixel unit under a side viewing angle is close to the gray scale brightness curve under a front viewing angle, long term operation is further ensured to achieve a uniform display effect, better protection for the display panel is formed, and such design is favorable for improving a picture display quality.

Another embodiment of the disclosure provides a driving device for a display panel, adopting the driving method for a display panel according to any above embodiment. For example, the driving device for a display panel is implemented by adopting the driving method for a display panel according to any above embodiment. For another example, the driving device for a display panel has function modules corresponding to the driving method for a display panel according to any above embodiment.

The driving method and driving device for a display panel according to the present application may be for example applied to a liquid crystal display panel, an organic light-emitting diode (OLED) display panel, a quantum dot light emitting diodes (QLED) display panel, a curve surface display panel, or a flexible display panel, etc. For another example, the liquid crystal display panel as an example may be a twisted nematic (TN) liquid crystal display panel, an in-plane switching (IPS) liquid crystal display panel, a plane to line switching (PLS) liquid crystal display panel, or a multi-domain vertical alignment (MVA) liquid crystal display panel, etc. Wherein the display panel may be driven by adopting a logic board of a full high definition display panel. That is, the above driving method and driving device for a display panel may be implemented by adopting the logic board of the full high definition display panel.

Figure 7:
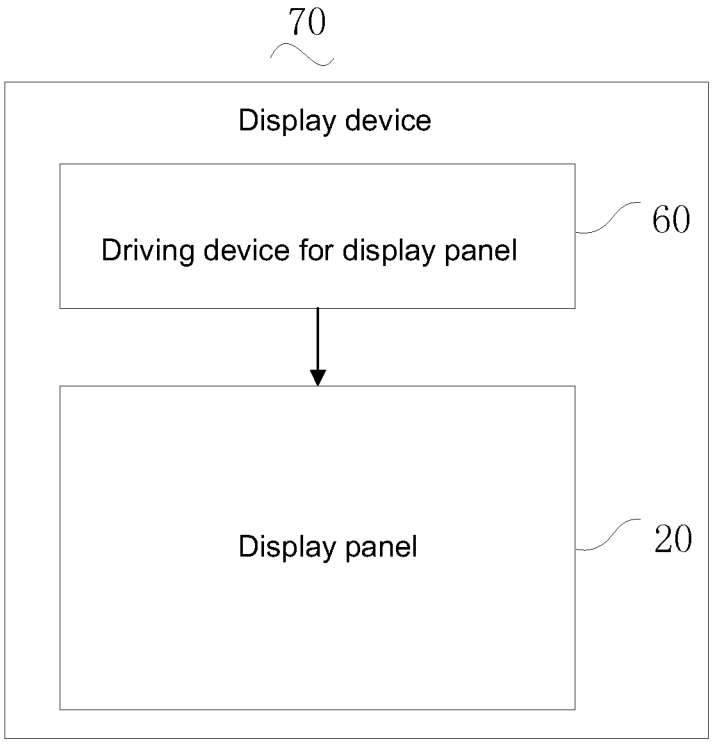
FIG. 7 is a structural schematic view of a display device according to an embodiment.

The disclosure further discloses a display device, as shown in FIG. 7, the display device 70 includes a display panel 20 and the driving device 60 for a display panel according to any above embodiment, and the driving device is connected to the display panel.

For example, the display device is a liquid crystal display device, an OLED display device, a QLED display device, a curve surface display device, a flexible display device, etc. For another example, the liquid crystal display device as an example may be a TN liquid crystal display, an IPS liquid crystal display, a PLS liquid crystal display or an MVA liquid crystal display, etc.

In one of the embodiments, the driving device includes a grouping module, configured for dividing a plurality of pixel units of the display panel into a plurality of pixel groups, such that each pixel group includes three columns of continuously arranged pixel units, and the three columns of continuously arranged pixel units are a first position pixel unit, a second position pixel unit and a third position pixel unit respectively, the plurality of pixel units comprises a plurality of first pixel units and a plurality of a second pixel units, and each pixel unit comprises a plurality of sub-pixels; a drive module, including a first drive unit, a second drive unit and a third drive unit; wherein the first drive unit is configured for applying a drive voltage opposite to a polarity of the first position pixel unit to the second position pixel unit and the third position pixel unit in a same pixel group respectively; the second drive unit is configured for applying drive voltages of opposite polarities to every adjacent two columns of the sub-pixels in a same column of the pixel units respectively; and the third drive unit is configured for applying drive voltages of different voltage levels to the sub-pixels in the first pixel units and the sub-pixels in the second pixel units respectively; wherein the first pixel units and the second pixel units are adjacently disposed in the display panel.

In one of the embodiments, in the driving device, the first drive unit is further configured for applying drive voltages of opposite polarities to the first position pixel unit and the second position pixel unit in the same pixel group respectively; and applying a drive voltage same as the polarity of the second position pixel unit to the third position pixel unit in the same pixel group.

In one of the embodiments, in the driving device, the pixel unit includes a first sub-pixel, a second sub-pixel and a third sub-pixel which are arranged in sequence; the first drive unit includes a first drive subunit, configured for, in the same pixel group, applying a drive voltage of a first polarity to the first sub-pixel and the third sub-pixel of the first position pixel unit respectively, applying a drive voltage of a second polarity to the first sub-pixel and the third sub-pixel of the second position pixel unit respectively, and applying a drive voltage of a second polarity to the first sub-pixel and the third sub-pixel of the third position pixel unit respectively; and a second drive subunit, configured for applying a drive voltage of a second polarity to the second sub-pixel of the first position pixel unit, applying a drive voltage of a first polarity to the second sub-pixel of the second position pixel unit, and applying a drive voltage of a first polarity to the second sub-pixel of the third position pixel unit; wherein the first polarity and the second polarity are opposite polarities. In one of the embodiments, in the driving device, the drive module further includes a fourth drive unit, configured for, in every adjacent two frame display time, alternately applying drive voltages of opposite polarities to the same sub-pixel. In one of the embodiments, in the driving device, applying drive voltages of different voltage levels to the sub-pixels in the first pixel units and the sub-pixels in the second pixel units respectively includes applying the drive voltage of a preset first voltage level to the sub-pixels in the first pixel units; and applying the drive voltage of a preset second voltage level to the sub-pixels in the second pixel units. As an embodiment, the preset first drive voltage level and the preset second drive voltage level are two different values in an array respectively. For example, the array is a preset drive voltage level array, and contains a plurality of different drive voltage levels, and the preset first drive voltage level and the preset second drive voltage level are two different drive voltage levels in the preset drive voltage level array.

In one of the embodiments, in the driving device, the first drive unit is further configured for applying drive voltages of opposite polarities to the first position pixel unit and the second position pixel unit in the same pixel group respectively; and applying a drive voltage same as the polarity of the second position pixel unit to the third position pixel unit in the same pixel group; the pixel unit includes a first sub-pixel, a second sub-pixel and a third sub-pixel arranged in sequence; and the first drive unit includes a first drive subunit, configured for, in the same pixel group, applying a drive voltage of a first polarity to the first sub-pixel and the third sub-pixel of the first position pixel unit respectively, applying a drive voltage of a second polarity to the first sub-pixel and the third sub-pixel of the second position pixel unit respectively, and applying a drive voltage of a second polarity to the first sub-pixel and the third sub-pixel of the third position pixel unit respectively; wherein applying drive voltages of different voltage levels to the sub-pixels in the first pixel units and the sub-pixels in the second pixel units respectively includes applying the drive voltage of a preset first voltage level to the sub-pixels in the first pixel units; and applying the drive voltage of a preset second voltage level to the sub-pixels in the second pixel units; a second drive subunit, configured for applying a drive voltage of a second polarity to the second sub-pixel of the first position pixel unit, applying a drive voltage of a first polarity to the second sub-pixel of the second position pixel unit, and applying a drive voltage of a first polarity to the second sub-pixel of the third position pixel unit; wherein the first polarity and the second polarity are opposite polarities; the drive module further includes a fourth drive unit, configured for, in every adjacent two frame display time, alternately applying the drive voltages of opposite polarities to the same sub-pixel.

Respective technical characteristics of above embodiments can be freely combined, and for the purpose of compact description, not all possible combinations of the respective technical characteristics of above embodiments are described. However, as long as the combinations of these technical characteristics have no conflicts, they are considered to be within a scope of the specification.

The foregoing merely expresses several embodiments of the disclosure, which are described in a relatively specific and detailed manner, but should be understood as a limitation to the scope of the disclosure. It should be pointed out that those ordinary skilled in the art could make a plurality of transformations and improvements without departing from a concept of the disclosure, and they all fall within the protective scope of the disclosure. Therefore, a protective scope of the disclosure should take appended claims as a criterion.

What is claimed is:

1. A driving method for a display panel, comprising dividing a plurality of pixel units of the display panel into a plurality of pixel groups, wherein each pixel group comprises three columns of continuously arranged pixel units, and the three columns of continuously arranged pixel units comprise a first position pixel unit, a second position pixel unit and a third position pixel unit respectively, the plurality of pixel units comprises a plurality of first pixel units and a plurality of a second pixel units, and each pixel unit comprises a plurality of sub-pixels;

applying a drive voltage opposite to a polarity of the first position pixel unit to the second position pixel unit and the third position pixel unit in a same pixel group respectively;

applying drive voltages of opposite polarities to every adjacent two columns of the sub-pixels in a same column of the pixel units respectively, and applying drive voltages of a first voltage level to the sub-pixels in the first pixel units while applying drive voltages of a second voltage level different from the first voltage level to the sub-pixels in the second pixel units, wherein the plurality of sub-pixels in the same pixel unit are applied with the drive voltages of a same one of the first voltage level and the second voltage level;

wherein the first pixel units and the second pixel units are arranged alternately in each row as well as in each column in the display panel; and wherein in every adjacent two frame display times, the drive voltage of the same sub-pixel is changed in polarity while the drive voltage of the same sub-pixel is kept unchanged in voltage level, and in each of the adjacent two frame display times, the sub-pixels in each column have a same polarity.

2. The driving method according to claim 1, wherein applying a drive voltage opposite to a polarity of the first position pixel unit to the second position pixel unit and the third position pixel unit in a same pixel group respectively comprises applying drive voltages of opposite polarities to the first position pixel unit and the second position pixel unit in the same pixel group respectively; and applying a drive voltage same as the polarity of the second position pixel unit to the third position pixel unit in the same pixel group.

3. The driving method according to claim 2, wherein the pixel unit comprises a first sub-pixel, a second sub-pixel and a third sub-pixel which are arranged in sequence;

applying drive voltages of opposite polarities to the first position pixel unit and the second position pixel unit in the same pixel group respectively; and applying a drive voltage same as the polarity of the second position pixel unit to the third position pixel unit in the same pixel group, comprises in the same pixel group, applying a drive voltage of a first polarity to the first sub-pixel and the third sub-pixel of the first position pixel unit respectively, applying a drive voltage of a second polarity to the first sub-pixel and the third sub-pixel of the second position pixel unit respectively, and applying a drive voltage of a second polarity to the first sub-pixel and the third sub-pixel of the third position pixel unit respectively; and applying a drive voltage of a second polarity to the second sub-pixel of the first position pixel unit, applying a drive voltage of a first polarity to the second sub-pixel of the second position pixel unit, and applying a drive voltage of a first polarity to the second sub-pixel of the third position pixel unit;

wherein the first polarity and the second polarity are opposite polarities.

4. The driving method according to claim 1, wherein applying a drive voltage opposite to a polarity of the first position pixel unit to the second position pixel unit and the third position pixel unit in a same pixel group respectively comprises applying drive voltages of opposite polarities to the first position pixel unit and the second position pixel unit in the same pixel group respectively; and applying a drive voltage same as the polarity of the second position pixel unit to the third position pixel unit in the same pixel group;

wherein the pixel unit comprises a first sub-pixel, a second sub-pixel and a third sub-pixel arranged in sequence;

applying drive voltages of opposite polarities to the first position pixel unit and the second position pixel unit in the same pixel group respectively; and applying a drive voltage same as the polarity of the second position pixel unit to the third position pixel unit in the same pixel group, comprises in the same pixel group, applying a drive voltage of a first polarity to the first sub-pixel and the third sub-pixel of the first position pixel unit respectively, applying a drive voltage of a second polarity to the first sub-pixel and the third sub-pixel of the second position pixel unit respectively, and applying a drive voltage of a second polarity to the first sub-pixel and the third sub-pixel of the third position pixel unit respectively; and applying a drive voltage of a second polarity to the second sub-pixel of the first position pixel unit, applying a drive voltage of a first polarity to the second sub-pixel of the second position pixel unit, and applying a drive voltage of a first polarity to the second sub-pixel of the third position pixel unit;

wherein the first polarity and the second polarity are opposite polarities.

5. A display device, comprising a display panel and a driving device connected to the display panel, wherein the driving device is configured for dividing a plurality of pixel units of the display panel into a plurality of pixel groups, such that each pixel group comprises three columns of continuously arranged pixel units, and the three columns of continuously arranged pixel units are a first position pixel unit, a second position pixel unit and a third position pixel unit respectively, the plurality of pixel units comprises a plurality of first pixel units and a plurality of a second pixel units, and each pixel unit comprises a plurality of sub-pixels;

configured for applying a drive voltage opposite to a polarity of the first position pixel unit to the second position pixel unit and the third position pixel unit in a same pixel group respectively;

configured for applying drive voltages of opposite polarities to every adjacent two columns of the sub-pixels in a same column of the pixel units respectively; and configured for applying drive voltages of a first voltage level to the sub-pixels in the first pixel units while applying drive voltages of a second voltage level different from the first voltage level to the sub-pixels in the second pixel units, wherein the plurality of sub-pixels in the same pixel unit are applied with the drive voltages of a same one of the first voltage level and the second voltage level;

wherein the first pixel units and the second pixel units are arranged alternately in each row as well as in each column in the display panel; and wherein in every adjacent two frame display times, the drive voltage of the same sub-pixel is changed in polarity while the drive voltage of the same sub-pixel is kept unchanged in voltage level, and in each of the adjacent two frame display times, the sub-pixels in each column have a same polarity.

6. The display device according to claim 5, wherein applying a drive voltage opposite to a polarity of the first position pixel unit to the second position pixel unit and the third position pixel unit in a same pixel group respectively, comprises:

applying drive voltages of opposite polarities to the first position pixel unit and the second position pixel unit in the same pixel group respectively; and applying a drive voltage same as the polarity of the second position pixel unit to the third position pixel unit in the same pixel group.

7. The display device according to claim 5, wherein the pixel unit comprises a first sub-pixel, a second sub-pixel and a third sub-pixel which are arranged in sequence; applying a drive voltage opposite to a polarity of the first position pixel unit to the second position pixel unit and the third position pixel unit in a same pixel group respectively, comprises:

in the same pixel group, applying a drive voltage of a first polarity to the first sub-pixel and the third sub-pixel of the first position pixel unit respectively, applying a drive voltage of a second polarity to the first sub-pixel and the third sub-pixel of the second position pixel unit respectively, and applying a drive voltage of a second polarity to the first sub-pixel and the third sub-pixel of the third position pixel unit respectively; and applying a drive voltage of a second polarity to the second sub-pixel of the first position pixel unit, applying a drive voltage of a first polarity to the second sub-pixel of the second position pixel unit, and applying a drive voltage of a first polarity to the second sub-pixel of the third position pixel unit;

wherein the first polarity and the second polarity are opposite polarities.

* * * * *